United States Patent [19]

Matsuuchi

[11] Patent Number: 4,982,231

[45] Date of Patent: Jan. 1, 1991

[54] WASTE TONER RECOVERY DEVICE FOR USE IN ELECTROSTATIC COPYING MACHINES

[75] Inventor: Yasuyuki Matsuuchi, Osaka, Japan

[73] Assignee: Minolta Camera Kabushiki Kaisha, Osaka, Japan

[21] Appl. No.: 374,920

[22] Filed: Jul. 3, 1989

[30] Foreign Application Priority Data

Jul. 8, 1988 [JP] Japan ..... 63-171557

[51] Int. Cl.[5] ..... G03G 21/00

[52] U.S. Cl. ..... 355/206; 355/298

[58] Field of Search ..... 355/204–209, 355/245, 298

[56] References Cited

U.S. PATENT DOCUMENTS 3,838,922 10/1974 Nelson ..... 355/298
4,627,716 12/1986 Oka .
4,851,875 7/1989 Tanimoto ..... 355/245

FOREIGN PATENT DOCUMENTS 58-195873 11/1983 Japan ..... 355/298
59-36276 2/1984 Japan ..... 355/298
60-15668 1/1985 Japan ..... 355/208
60-22173 2/1985 Japan .
60-198571 10/1985 Japan .
61-25169 2/1986 Japan ..... 355/206

*Primary Examiner*—R. L. Moses
*Attorney, Agent, or Firm*—Wenderoth, Lind & Ponack

[57] ABSTRACT

A waste toner recovery device for use in electrostatic copying machines has a sensor and control unit which provide an advance warning when the volume of waste toner in a waste toner recovery bottle reaches a specific warning-start quantity. The control unit allows a desired value corresponding to the warning-start quantity to be selected in the copying machine.

10 Claims, 9 Drawing Sheets

WASTE TONER RECOVERY DEVICE FOR USE IN ELECTROSTATIC COPYING MACHINES

BACKGROUND OF THE INVENTION

Field of the Invention

The present invention relates to a waste toner recovery device, and more specifically relates to a waste toner recovery device which collects residual powder developing material on the surface of a photoreceptor member used in electrostatic copying machines, laser printers, and like image forming apparatus.

DESCRIPTION OF THE RELATED ART

An example of a conventional waste toner recovery device for copying machines is shown in FIG. 1. The waste toner recovery device shown in the drawing has a collecting vessel 101 disposed on a support plate 100 which is rotatable about an axis at one end 100*a* thereof that is supported by a shaft. The free end 100*b* of support plate 100 is supported by a spring 103. Transport pipe 104 guides waste toner to the recovery vessel 101. A switch 102 is provided below the free end 100*b* side of support plate 100.

In the aforesaid device, until the waste toner accommodated in the collecting vessel 101 accrues to a specific quantity, the free end 100*b* is maintained in the state where it makes contact with stopper 105 by means of the force exerted by spring 103. When the waste toner accommodated in the collecting vessel 101 reaches the aforesaid specific quantity, spring 103 is extended by means of the weight of said waste toner, the support plate 100 swings downwardly, and switch 102 is switched from the OFF state to the ON state. A warning is displayed on the copying machine control panel by means of the ON signal output by the aforesaid switch 102. When setting the specific quantity of waste toner mentioned above which switches switch 102 to the ON state, consideration should be given to the maintenance period for replacing the collecting vessel or discharging the waste toner accommodated therein, that is, the value should be set at less than maximum capacity so that the copy machine is capable of processing 100 to 1,000 copies after the warning is displayed.

In the conventional waste toner recovery device described above, the quantity of the waste toner necessary to start the warning display is determined by the arrangement of switch 102 and the strength of spring 103 because the warning is displayed based on a two-value ON/OFF signal from switch 102. Accordingly, there may be a large delay between when the warning display is started and the collection vessel 101 is filled to the specified waste toner quantity depending on the monthly frequency of use of the copying machine. For example, when switch 102 is set so as to switch ON at a point that ensures that collecting vessel 101 has a sufficient remaining capacity to accommodate the waste toner produced by copy processing of about 1,000 copies, users who make about 1,000 copies per month will reach maximum capacity after about one month, while users who make 10,000 copies per month will reach maximum capacity after about three days.

The former user can still make copies during a suitable maintenance period after the warning display has started, while the latter user cannot ensure sufficient maintenance time after the warning display has started and may encounter the problem of a filled-to-capacity collecting vessel 101.

SUMMARY OF THE INVENTION

Accordingly, a main object of the present invention is to provide a superior waste toner recovery device capable of eliminating the aforesaid problems.

A further object of the invention is to provide a waste toner recovery device capable of setting that waste toner volume accommodated in the collecting vessel which produces the previously described warning display.

These and other objects are attained by a waste toner recovery device comprising a recovery device for collecting waste toner, a toner volume detecting means which outputs a signal that changes according to the waste toner volume accommodated in the collecting vessel, a warning means which issues a warning when the waste toner volume detected by the toner volume detecting means reaches a specific warning-start quantity, and an input means for entering a desired value as the aforesaid warning-start quantity.

BRIEF DESCRIPTION OF THE DRAWINGS

These and other objects and features of the present invention will become apparent from the following description of a preferred embodiment thereof taken in conjunction with the accompanying drawings.

In the following description, like parts are designated by like reference numbers throughout the several drawings.

DETAILED DESCRIPTION OF THE PREFERRED EMBODIMENT

An embodiments of the present invention will be described hereinafter with reference to the accompanying drawings.

The present embodiment uses the waste toner recovery device of the present invention in an electrostatic copying machine 1.

Figure 1:
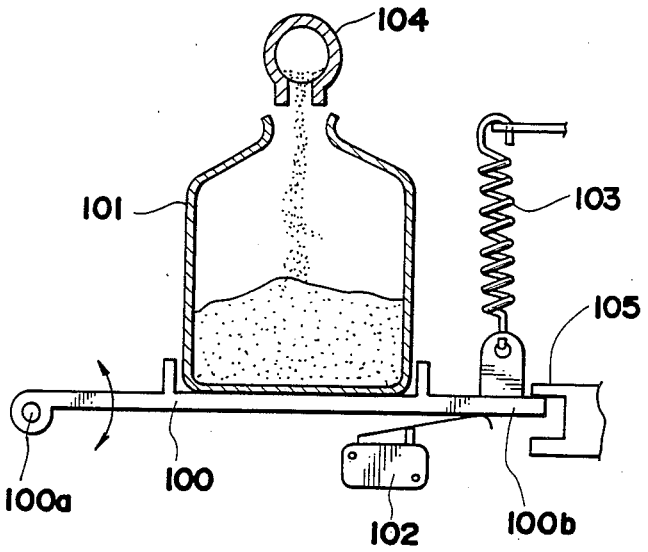
FIG.1 PRIOR ART
FIG. 1 is a side view, partly in section of a conventional waste toner recovery device.
Figure 2:
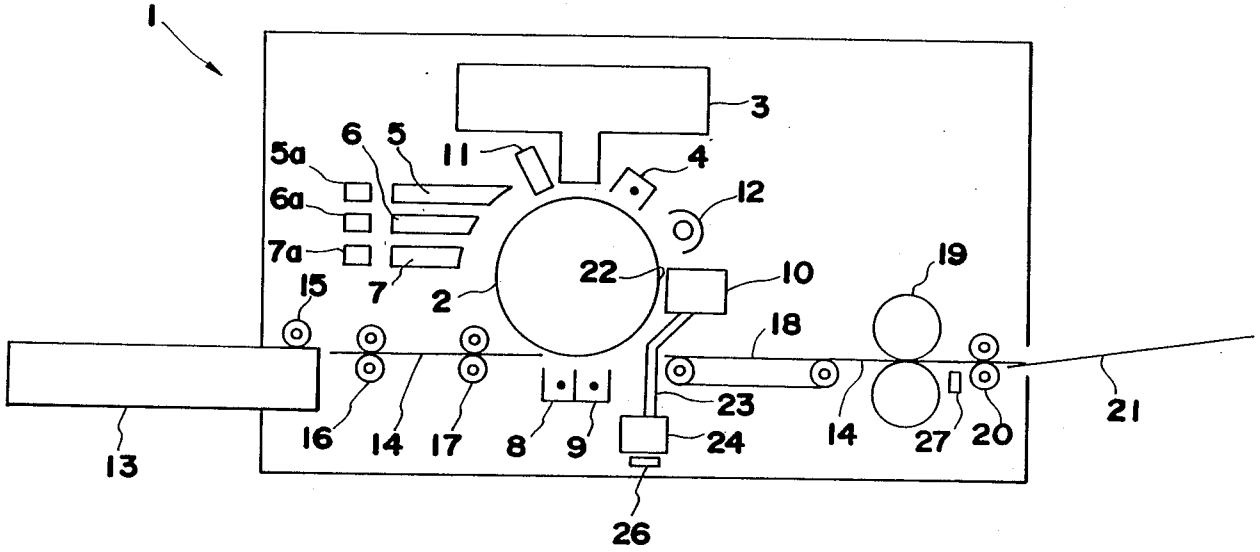
FIG. 2 is a schematic diagram of an electrostatic copying machine.

FIG. 2 shows a simplified interior structure of the copying machine 1. A photoreceptor drum 2 is provided in the middle portion of copying machine 1, and above said photoreceptor drum 2 is disposed an optical unit 3 which exposes an original document image on the surface of said photoreceptor drum 2.

Around the periphery of the photoreceptor drum 2 are provided a charger 4, developing units 5, 6 and 7, transfer charger 8, separation charger 9, cleaning unit 10, eraser lamp 11, and discharging lamp 12. The surface of photoreceptor drum 2 is charged by charger 4 prior to exposure by optical unit 3, so that when said drum 2 surface is exposed by the optical unit 3, an electrostatic latent image corresponding to the original document image is formed thereon. This electrostatic latent image is then developed into a toner image by having toner supplied from developing units 5, 6 and 7 adhered thereto. Each developing unit 5, 6 and 7 is constructed so as to be independently functional by means of a solenoid and electromagnetic spring clutch not shown in the drawing. Each developing unit 5, 6 and 7 is respectively provided with individual toner supply sections 5*a*, 6*a* and 7*a* from which toner is supplied.

On the other hand, recording paper 14 which is stacked in paper cassette 13 is repeatedly discharged therefrom by means of the rotation of paper feed roller 15, and is transported to timing rollers 17 via intermediate rollers 16. Timing rollers 17 are synchronously actuated with the rotation of the photoreceptor drum 2, so that recording paper 14 will have the toner image transferred thereto by means of the transfer charger 8. The transferred recording sheet 14 is separated from photoreceptor drum 2 by the separation charger 9, and is transported through transport section 18 to fixing rollers 19, whereupon said toner image is subjected to heat and pressure and is fixed to said recording sheet. The fixed recording sheet 14 is then transported onto discharge tray 21 by discharge rollers 20.

The operation of the aforesaid photoreceptor drum 2, sheet feed roller 15, intermediate rollers 16, timing rollers 17, transport section 18, fixing rollers 19, and discharge rollers 20 is accomplished by a main motor not shown in the drawing according to their respectively set timing. Since the construction of the aforesaid components in copy machine 1 are commonly known, a detailed explanation thereof is not provided herein.

Subsequently, after the toner image is transferred to the recording sheet 14 by transfer charger 8, residual toner remaining on the surface of the photoreceptor drum 2 (hereinafter referred to as "waste toner") is scraped therefrom by blade 22 of cleaning unit 10. In addition, the residual charge remaining on the surface of said photoreceptor drum 2 is removed by a discharging lamp 12.

Figure 3:
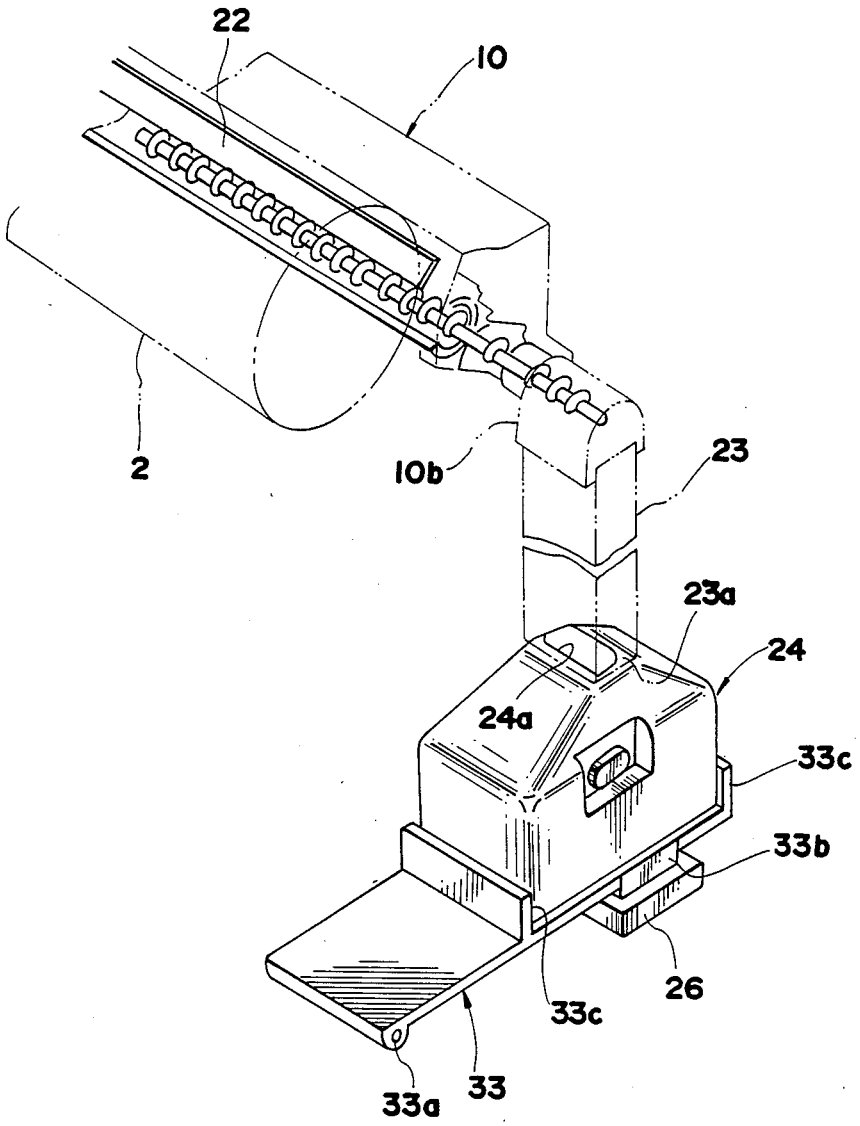
FIG. 3 is a perspective view of a collecting bottle and pressure sensor according to the present invention.
Figure 4:
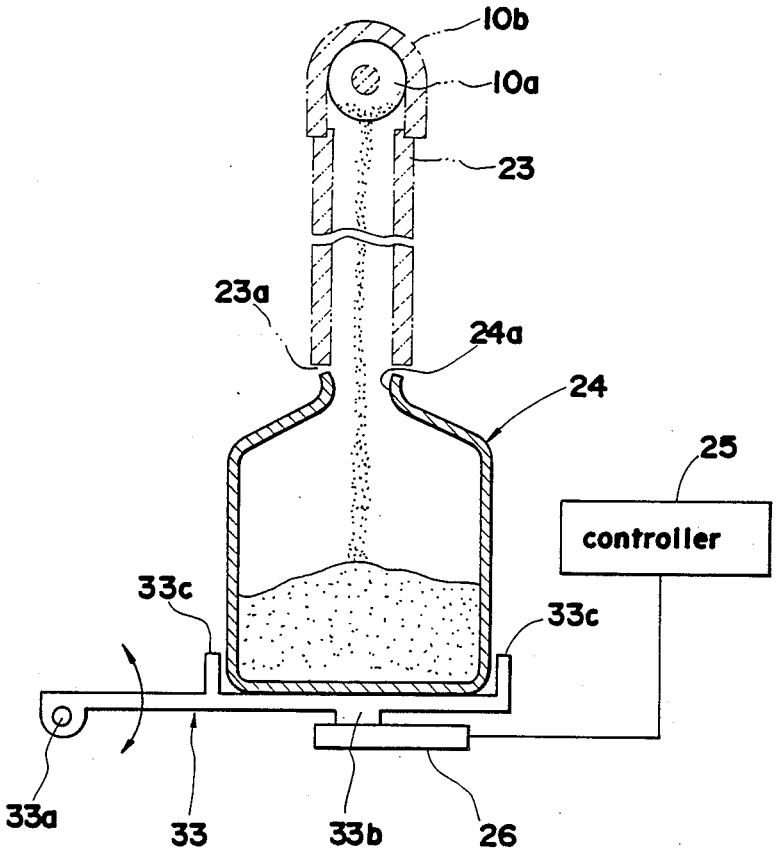
FIG. 4 is a schematic diagram of the collecting bottle and pressure sensor shown in FIG. 3.

The waste toner scraped by the aforesaid blade 22 is transported, as shown in FIGS. 3 and 4, from the interior of cleaning unit 10 to the front of a transport pipe 10*b* having provided therein a transport impeller 10*a* horizontally disposed toward the front of copying machine 1 and rotated by a motor not shown in the drawing. The front end of transport pipe 10*b* extends downward and is connected to a communicating collecting pipe 23, so that the waste toner transported within said transport pipe 10*b* collects in a waste toner recovery device through said collecting pipe 23.

The waste toner recovery device, as shown in FIGS. 2 through 5, provides a collecting bottle 24 disposed below collecting pipe 23, and a pressure sensor 26 which detects the weight of said collecting bottle 24 and outputs as an analog value a detection signal corresponding to said weight. Still referring to FIGS. 2 through 5, copying machine 1 is provided with a controller 25, a discharge switch 27 which detects the discharge of recording sheet 14 in order to count the number of copied sheets 14, a display portion 29, operation part 30, and random access memory (RAM) 31.

Figure 5:
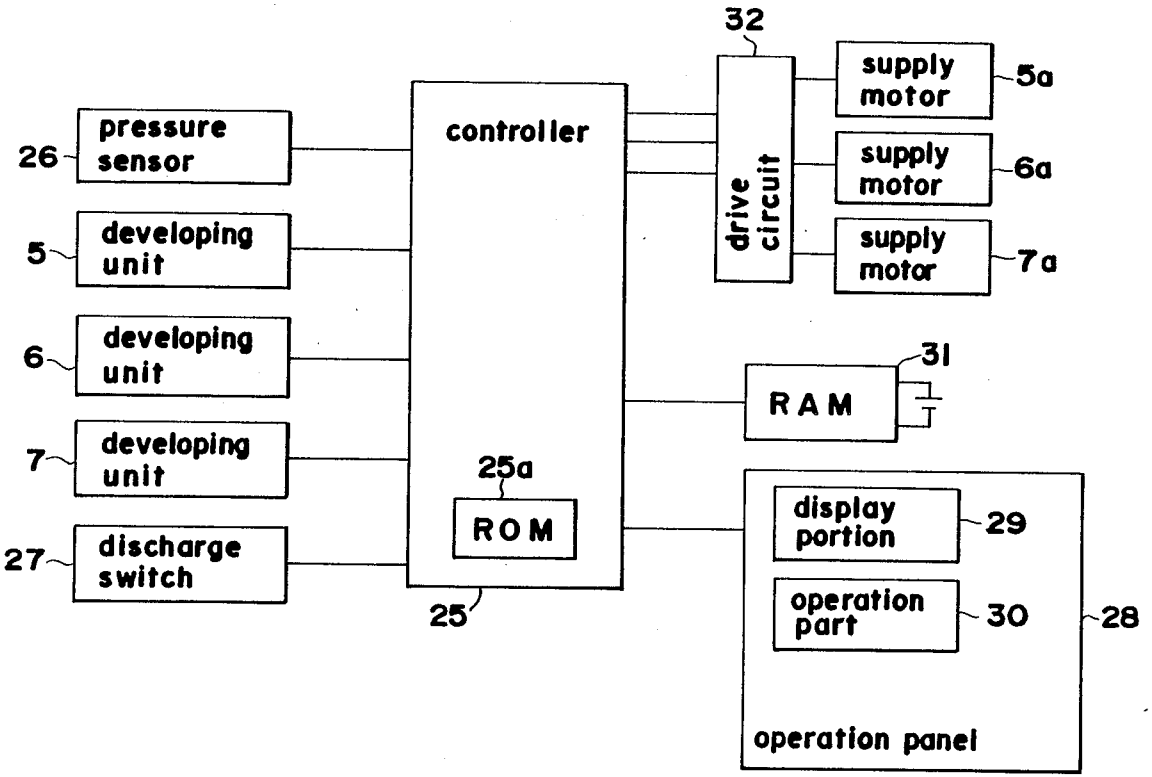
FIG. 5 is a block diagram of the control unit including the pressure sensor.

As shown in FIG. 5, controller 25 comprises a one-chip microcomputer having an internal A/D converter and input/output interface, and is provided with a read only memory (ROM) 25*a* which stores the previously input data for initialization values and the control programs to control copying functions and the aforesaid warning process. Controller 25 receives the various signals output by the pressure sensor 26 and the discharge switch 27, and the detection signals of the remaining developing toner from developing units 5, 6 and 7. On the other hand, drive signals are output from controller 25 to each of the supply portions 5*a*, 6*a* and 7*a*.

Pressure sensor 26 is disposed beneath the free end of baseplate 33, said baseplate 33 being capable of swinging vertically at the opposite end around a support shaft 33*a* which is mounted to the body of copying machine 1, as shown in FIGS. 3 and 4.

Base plate 33 has disposed on the underside thereof a pressure portion 33*b* in contact with a pressure sensitive portion (not shown in the drawings) of pressure sensor 26, said base plate 33 being maintained in a horizontal state by means of the support of pressure sensor 26 through pressure portion 33*b*. Base plate 33 has mounted thereon the collecting bottle 24 as previously described, said base plate having provided on its top side a mounting frame 33*c* which corresponds to the bottom configuration of collecting bottle 24. Base plate 33 uses a 50 g weight.

Collecting bottle 24 has a collecting mouth 24*a* on the top thereof, and is set within the set of frames 33*c* on base plate 33. Collecting mouth 24*a* confronts the discharge mouth 23*a* formed at the bottom end of collecting pipe 23, so as to allow waste toner to pass therethrough. Collecting bottle 24 uses a 75 g weight, said collecting bottle 24 being in the full state when 225 g of toner are accommodated therein.

Figure 7:
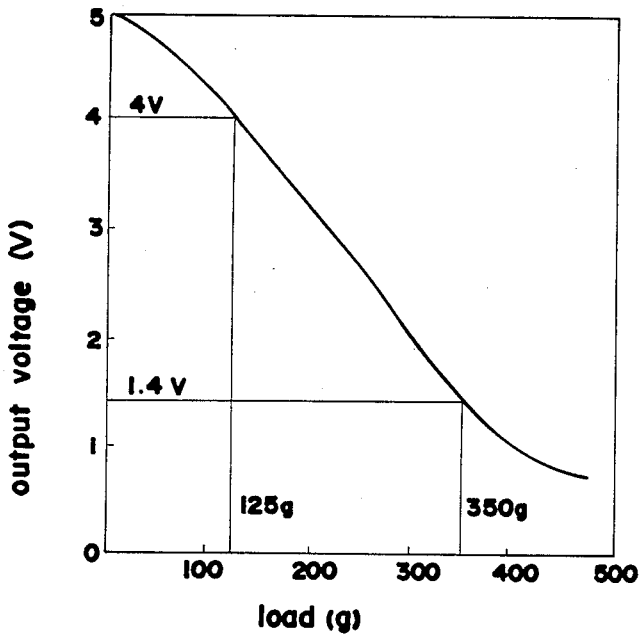
FIG. 7 is a graph showing the relationship between the pressure sensor load and output voltage.

Pressure sensor 26 is provided on the copy machine 1 base and confronts the underside of base plate 33, said pressure sensor 26 having a pressure sensitive portion (not shown) positioned to correspond with the center of collecting bottle 24 mounted on base plate 33. In the present embodiment, pressure sensor 26 uses a load sensor, and outputs a voltage that changes according to the detected weight. That is, the output voltage grows smaller in accordance with an increase in load, as shown in FIG. 7. For example, when the load is 125 g, the output voltage is 4 V, and when the load is 350 g, the output voltage is 1.4 V.

Figure 6:
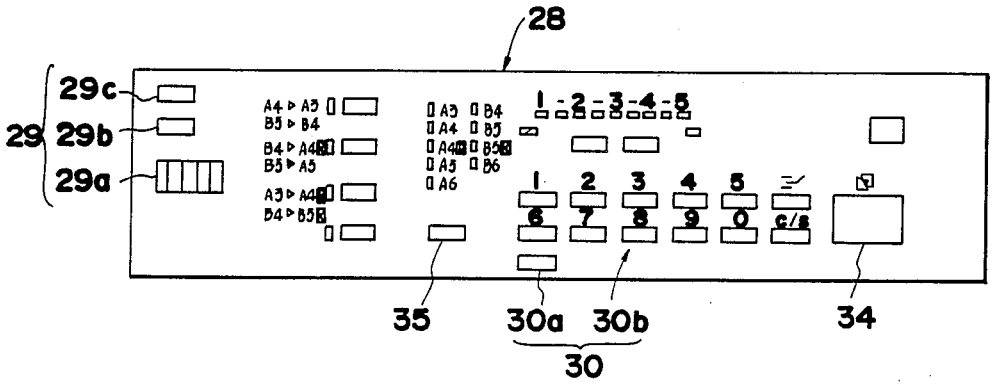
FIG. 6 is a front view of the control panel of the electrostatic copying machine.

Operation panel 28 is provided on the top face of the copying machine housing, and includes a conventional operation panel having, as shown in FIG. 6, keys such as a ten key pad 30*b*, print key 34, paper size indicator key 35, display window and the like arranged thereon, as well as a display portion 29 used for warning displays (comprising a possible copy number display window 29*a*, waste toner warning lamp 29*b*, copy operation terminate warning lamp 29*c*), and operation portion 30 for setting a desired time for the warning start time (control portion 30 includes a set key 30*a* and the related ten key pad 30*b* previously mentioned).

The RAM 31 stores the individual counter and copy cycle data necessary to control the conventional copy functions and the previously described warning process executed by the controller 25. The RAM 31 is constructed so as to hold the stored data by means of a backup power source.

Figure 8:
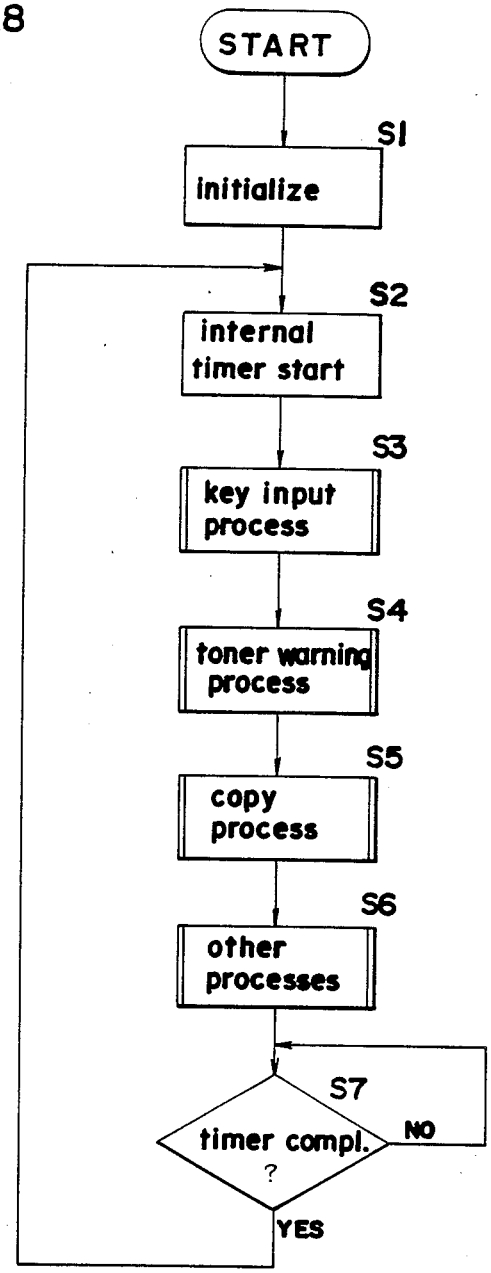
FIG. 8 is a flow chart of the main control routine of the electrostatic copying machine.
Figure 9:
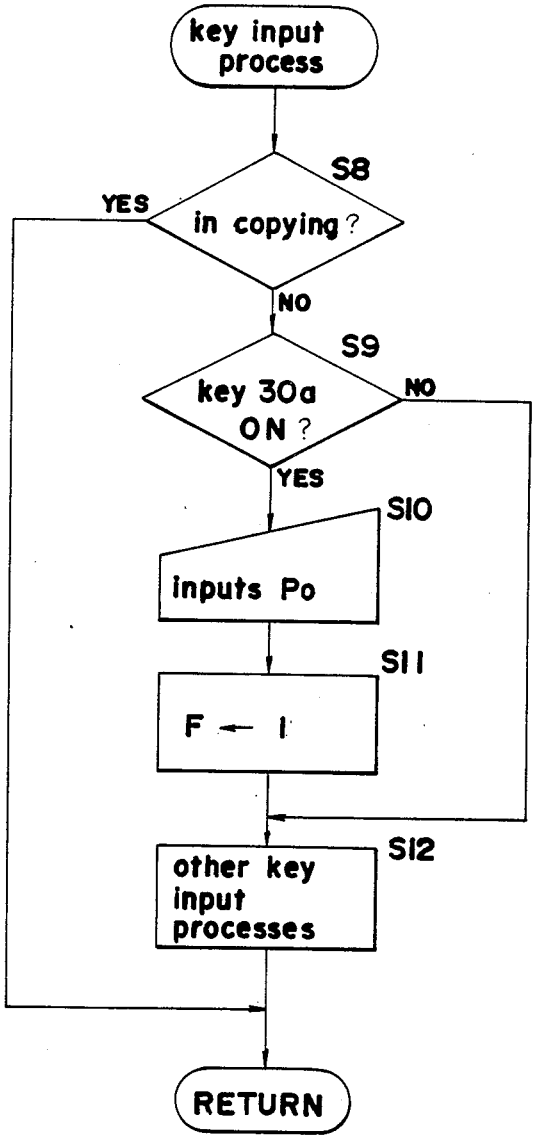
FIG. 9 is a flow chart of the key input process subroutine.
Figure 10:
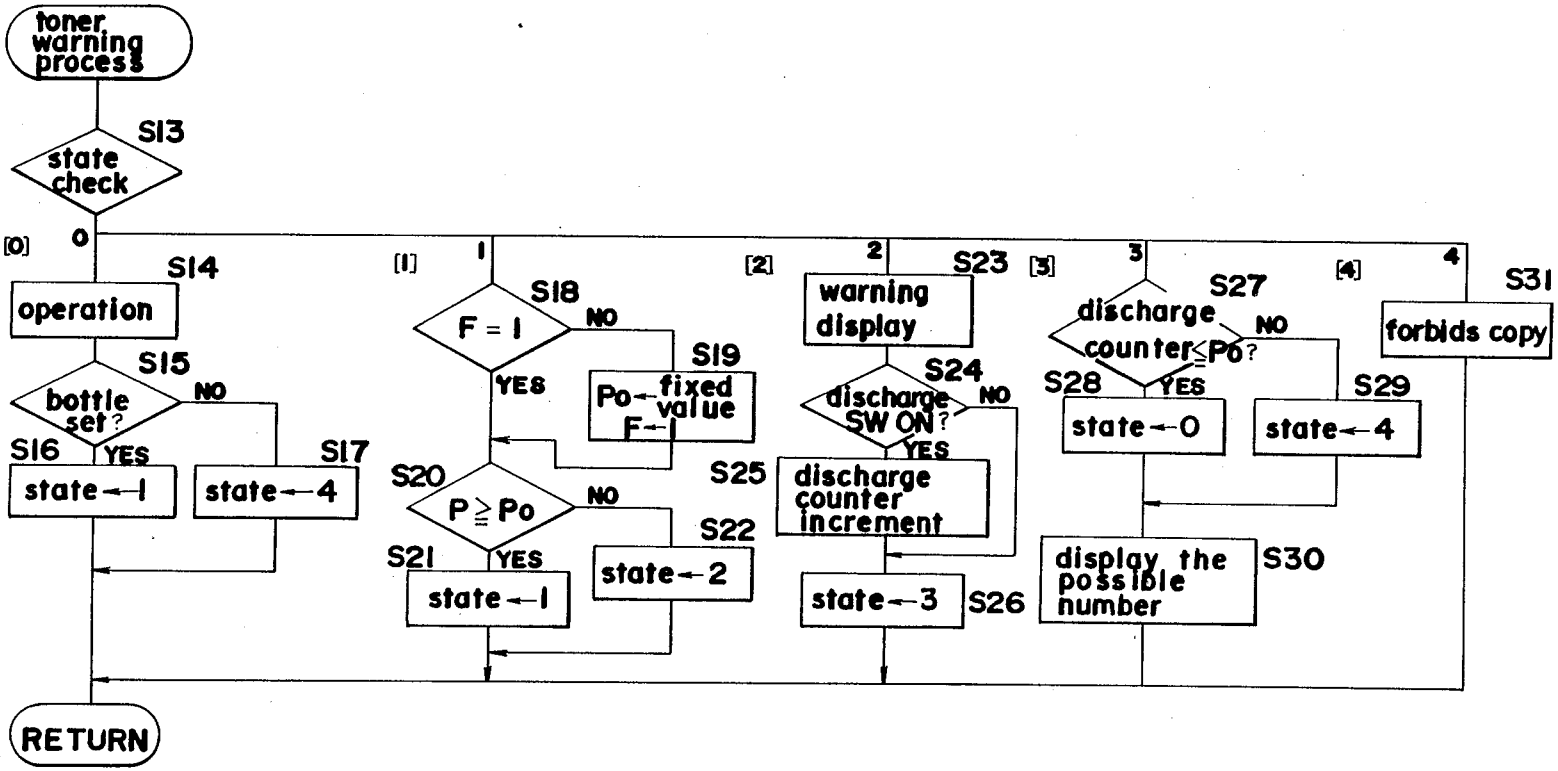
FIG. 10 is a flow chart of the warning process subroutines.

Next, the operation of the waste toner recovery device having the aforesaid structure is described with reference to flow charts shown in FIGS. 8, 9 and 10. FIG. 8 shows the main routine for executing all copy functions of copying machine 1. FIGS. 9 and 10 show the subroutines for executing the key input process and warning process included in the copy function processes of copying machine 1. Items labeled S1 through S31 in the drawings indicate each step in the routines.

When power to the copying machine 1 is switched ON, and the main routine control starts, as shown in FIG. 8, the machine systems are initialized in step S1, and the internal timer is actuated in step S2. The internal timer controls each routine of each process executed by controller 25, and controls the sequence of separate operation process subroutines until a set time measured by the timer lapses in step S7 in order to maintain synchronicity. The key input process is executed in step S3, waste toner warning process in step S4, copy process in step S5, and error display and other processes in step S6. Since the processes executed in steps S5 and S6 comprise conventional processing, descriptions of said processes are herein omitted.

The key input process of step S3 is detailed in FIG. 9 wherein in step S8 a determination is made as to whether or not the copy operation is in progress. If the determination is YES, the program returns to the main routine, and if the determination is NO, the routine continues to step S9. In step S9, a determination is made as to whether or not the set key **30*a* of operation panel 28 has been actuated and is in the ON state. If the determination is YES, the routines advances to step S10, and if the determination is NO, the routine jumps to step S12**.

In step S10, the input of the set value is awaited. This set value corresponds to the desired starting time to start the toner warning, and is converted to a copy sheet number (hereinafter referred to as the "warning sheet number Po") that corresponds to the volume of toner that can be accommodated in the remaining capacity of collection bottle 24 at the start of the warning. This set value is input to warning sheet number Po by the ten-key pad **30*b* after actuation of the set key 30*a*. When the warning sheet number Po is input, the routine continues to step S11, and the set flag F, which discriminates the setting of the warning sheet number Po, is set to "1", and the routine advances to step S12**.

In step S12, other processing occurs in accordance with other key input from operation panel 28, and thereafter the program returns to the main routine. The processing conducted in step S12 is identical to conventional key input processes, thus a description of these processes is omitted herein.

The toner warning process subroutine which is is executed in step S4 is shown in FIG. 10 wherein, in step S13, the state value is checked, and, as shown in the drawing, a suitable routine [0], [1], [2], [3], or [4] is executed depending on the aforesaid discriminated state value. The aforesaid state value may be one of five values, e.g., "0", "1", "2", "3", "4", or "5", and changes according to the progress of the toner warning process operation. At initialization (when copying machine 1 is started), the state value is set at "0", and the [0] routine is executed.

The [0] routine progresses from step S14 of which the output signal from pressure sensor 26 is read, the detection signal load is calculated and the previously mentioned remaining toner accommodating capacity is calculated from the aforesaid load, whereupon the routine advances to step S15. That is, the voltage output by pressure sensor 26 is received, and the load corresponding to said detection voltage is calculated from the graph shown in FIG. 7. Data corresponding to the graph is pre-input and stored in ROM **25*a* of controller 25**.

In step S15, a determination is made as to whether or not the collecting bottle 24 is positioned on the baseplate 33, i.e., whether or not the load calculated in step S14 is equal to or greater than 12.5 g, which is the combined weight of the collecting bottle 24 and the baseplate 33. If the determination is NO, the state value is updated to the value "4", while if the determination is YES, the state value is updated to the value "1" and the program returns to the main routine.

When the state value is "4", routine [4] is execute, and in step S31 the copy process is prohibited, and the indicating warning is accomplished by switching ON the warning lamp **29*c***.

When the state value is "1", i.e., when collecting bottle 24 is set in position, routine [1]is executed. In step S18, a determination is made as to whether or not a flag F is set to 1 (F=1). If the determination is YES, the subroutine jumps to step S20, while if the determination is NO, the routine advances to step S19 and the fixed value is set as the warning sheet number Po, the flag F is set to F=1, and the routine continues to step S20. The aforesaid fixed value is stored in ROM **25*a* and is pre-set during the manufacture of copying machine 1**.

In step S20, a determination is made as to whether or not the toner capacity possible sheet number P (corresponding to the remaining toner capacity) is equal to or greater than the warning sheet number Po. If the determination is YES, the routine continues to step S21, and the program returns to the main routine with the state value remaining at "1". If the determination is NO, the routine jumps to step S22 and the state value is updated to "2" and the program returns to the main routine. The aforesaid toner capacity possible sheet number P is calculated on the basis of the remaining toner accommodating capacity and the collected toner unit weight. The remaining toner accommodating capacity is a value derived from the load calculated in step S14. The collected toner unit weight is the weight of the toner scraped of the drum by blade 22 after a single copy process, and is a weight experientially determined for copying machine 1 and previously stored in ROM **25*a*. The estimated number of possible copies of recording sheet 14 until the waste toner in collecting bottle 24** reaches a maximum level is determined by means of the following equation:

Toner capacity possible sheet number=(Remaining toner capacity)/(Collected toner unit weight)

When the state value is "2", the subroutine continues to routine [3], the warning lamp is switched ON in step S23, and thereafter the routine advances to step S24.

In step S24, a determination is made as to whether or not the discharge switch 27 is in the ON state. If said determination is NO, the routine jumps to step S26, while if said determination is YES, the routine continues to step S25 and the discharge counter is incremented. When the routine advances to step S26.

The discharge counter counts the number of sheets 14 which are copied after the warning lamp 29b is switched ON in step S23, and the counter value is stored in RAM 31. After the copy process is prohibited in step S31 of the routine [4], the counter value is reset to "0".

In step S26, the state value is updated to "3" and the program returns to the main routine.

When the state value is "3", the subroutine proceeds to the [3] routine. In step S27, a determination is made as to whether or not the discharge counter registers less than the warning sheet number Po. If the determination is NO, the routine jumps to step S29, while if the determination is YES, the routine continues to step S28. In step S28, the state value is updated to "0", or in step S29 the state value is updated to "4" before the routine continues to step S30. In step S30, the number of possible copies, i.e., (warning sheet number Po)−(discharge counter value), is displayed in the possible copy number display window 29a, and the program returns to the main routine. Accordingly, when the determination is NO in step S27, the copy process is prohibited in step S31, and when the determination is YES, the program returns to routine [0]. Thus, in step S14, the updated output signal from pressure sensor 26 is read, and processing is executed from routine [0] to [3] routine as described below. Thus, in step S27 the warning lamp 29a is lighted until the discharge counter value exceeds the warning sheet number Po, and the number of possible copies is displayed in the possible copy number display window 29a.

According to the waste toner recovery device of the present embodiment, the warning sheet number Po may be optionally set by either the set key 30a or the ten-key pad 30b. When remaining toner capacity of collecting bottle 24 reaches the weight corresponding to the warning sheet number Po, the warning lamp 29b is lighted and remains ON from this point. Further, the possible copy number can be displayed at any and all times in the possible copy number display window 29a. Accordingly, optional warning start times can be set by inputting a warning sheet number Po so as to customize said display in accordance with the maintenance period required for replacement of the collecting bottle 24 in direct correspondence with the frequency of use by individual users. Also, after the warning is started by the switching ON of the warning lamp 29b, the status of the collecting bottle 24 is readily determined from the possible copy number displayed in the possible copy number display window 29a.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A waste toner recovery device in an electrostatic copying machine, said device comprising:

a collecting device for collecting waste toner;

toner volume detecting means associated with said collecting device for outputting signals indicative of the volume of waste toner collected in said collecting device;

warning means operatively connected to said toner volume detecting means for receiving the signals output thereby and for issuing a warning when said signals indicate that the volume of toner collected in said collecting device has reached a predetermined warning-start volume; and input means operatively connected to said warning means for allowing any desired one of a plurality of values to be issued to said warning means as a signal that establishes said predetermined warning-start volume.

2. The waste toner recovery device of claim 1, wherein said toner volume detecting means is a pressure sensor which detects a weight of said collecting device and outputs a detection signal corresponding to said weight.

3. The waste toner recovery device of claim 2, wherein said pressure sensor outputs a detection signal that is an analog signal.

4. The waste toner recovery device of claim 2, wherein said collecting device is disposed on said pressure sensor.

5. The waste toner recovery device of claim 1, and further comprising detecting means operatively connected to said toner volume collecting means for receiving the signals output thereby and for detecting the presence of said collecting device based on the signals output by said toner volume detecting means.

6. The waste toner recovery device of claim 1, wherein said input means includes an operation panel of an electrostatic copying machine.

7. A waste toner recovery device in an electrostatic copying machine, said device comprising;

a collecting device for collecting waste toner;

detecting means associated with said collecting device for determining a remaining capacity of said collecting device to collect waste toner and for outputting signals indicative of the remaining capacity;

warning means operatively connected to said detecting means for receiving the signals output thereby and for issuing a warning when said signals indicate that the remaining capacity has been reduced to a predetermined warning-start amount;

input means operatively connected to said warning means for allowing any desired one of a plurality of numbers of sheets, corresponding to the number of sheets which would cause a predetermined quantity of waste toner to be produced in the machine, to be input to said warning means as a signal that establishes said warning-start amount;

counting means for counting a number of sheets which are used to make copies in the machine after said warning has been issued; and prohibiting means operatively connected to said counting means for prohibiting copies from being made in the machine when the counted number of sheets reaches said desired one of a plurality of numbers.

8. A waste toner recovery device in an electrostatic copying machine, said device comprising:

a collecting device for collecting waste toner;

toner volume detecting means associated with said collecting device for outputting signals indicative of the volume of waste toner collected in said collecting device;

warning means operatively connected to said toner volume detecting means for receiving the signals output thereby and for issuing a warning when said signals indicate that the volume of toner collected in said collecting device has reached a predetermined warning-start volume; and input means operatively connected to said warning means for allowing an arbitrary sheet number, representative of the amount of copying necessary to be performed in the machine to fill up said collecting device with a predetermined quantity of waste toner, to be input to said warning means as a signal that establishes said predetermined warning-start volume.

9. The waste toner recovery device of claim 8, wherein said input means includes an operation panel of an electrostatic copying machine.

10. A waste toner recovery device in an electrostatic copy machine, said device comprising:

a collecting device for collecting waste toner;

a toner volume detecting means operatively connected to said collecting device for outputting signals indicative of the volume of waste toner collected in said collecting device;

warning means operatively connected to said toner volume detecting means for receiving the signals output thereby and for issuing a warning when said signals indicate that the volume of toner collected in said collecting device has reached a predetermined warning-start volume; and selecting means operatively connected to said warning means for allowing a desired setting that is issued to said warning means as a signal establishing said predetermined warning-start volume to be changed to a different desired setting for any said collecting device of a given capacity.

* * * * *